252-99 AU 166 EX
8/26/80 XR 4,219,435

United States Patent [19]
Biard et al.
[11] 4,219,435
[45] Aug. 26, 1980

[54] DETERGENT TABLET COATING

[75] Inventors: Daniel Biard, Wavre; Gérard J. Lichtfus, Brussels, both of Belgium; Hans J. Pracht, Osthofen; Wolfgang Kleeman, Worms, both of Fed. Rep. of Germany

[73] Assignee: The Proctor & Gamble Company, Cincinnati, Ohio

[21] Appl. No.: 964,220

[22] Filed: Nov. 27, 1978

[30] Foreign Application Priority Data

Nov. 27, 1977 [GB] United Kingdom ..... 49614/77

[51] Int. Cl.[2] ..... C11D 3/04; C11D 11/00; C11D 17/00

[52] U.S. Cl. ..... 252/90; 252/89.1; 252/99; 252/134; 252/135; 252/174; 252/174.13; 252/DIG. 16; 427/422; 427/431

[58] Field of Search ..... 252/89.1, 90, 91, 134, 252/135, 99, 174, 174.13, DIG. 16; 427/215, 398, 422, 431

[56] References Cited

U.S. PATENT DOCUMENTS

| | | | |
|---|---|---|---|
| 3,231,506 | 1/1966 | Schulerud | 252/540 |
| 3,247,122 | 4/1966 | Schaafsma | 252/135 |
| 3,318,817 | 5/1967 | Smith | 252/174 X |
| 3,324,038 | 6/1967 | Chaffee | 252/544 |
| 3,366,570 | 1/1968 | Slob | 252/99 |
| 3,562,164 | 2/1971 | Bittner | 252/95 |
| 3,637,509 | 1/1972 | Brennan | 252/99 |
| 4,048,351 | 9/1977 | Saeman . | |

FOREIGN PATENT DOCUMENTS

| | | |
|---|---|---|
| 989683 | 4/1965 | United Kingdom . |
| 1013686 | 12/1965 | United Kingdom . |
| 1031831 | 6/1966 | United Kingdom . |
| 1191356 | 5/1970 | United Kingdom . |

*Primary Examiner*—Dennis L. Albrecht

[57] ABSTRACT

A detergent tablet comprising an alkaline salt is provided with a coating of a hydrated salt having a melting point in the range from 30° C. to 95° C. The coating is applied in the form of a melt of the hydrated salt so that a good coating is formed without the need for lengthy drying times. Preferred materials for the coating are sodium acetate trihydrate, sodium metaborate tetrahydrate and sodium orthophosphate dodecahydrate.

11 Claims, No Drawings

DETERGENT TABLET COATING

The present invention relates to detergent tablets and, in particular, to coated detergent tablets, especially those adapted for use in automatic dishwashing machines.

Although cleaning compositions in tablet form have often been proposed, these have not (with the exception of soap bars for personal washing) gained any substantial success, despite the several advantages of products in a unit dispensing form. One of the reasons for this may be that detergent tablets require a relatively complex manufacturing process. In particular, it is often desirable to provide the tablet with a coating and this adds to the difficulties of manufacture.

While tablets without a coating are entirely effective in use, they usually lack the necessary surface hardness to withstand the abrasion that is a part of normal manufacture, packaging and handling. The result is that uncoated tablets suffer from abrasion during these processes, resulting in chipped tablets and loss of active material. Also, especially in the case of highly alkaline tablets such as are useful in automatic dishwashing machines, the outer surface of an uncoated tablet may be aggressive to the skin and even somewhat hazardous to handle. In such cases, tablet coating is highly desirable. Finally, coating of tablets is often desired for aesthetic reasons, to improve the outer appearance of the tablet or to achieve some particular aesthetic effect.

Numerous methods of tablet coating have been proposed, and many of these have been suggested for detergent tablets. However, all of these methods have certain disadvantages, as will be explained below.

Polymeric coatings for detergent tablets have been proposed in, for example, U.K. Pat. No. 989,683, No. 1,013,686 and No. 1,031,831. Although such coatings can provide excellent surface appearance and resistance to abrasion, they tend to have a lower solubility than is desirable, resulting in the presence of undissolved polymer in the wash solution. Also, polymeric coatings are difficult to apply; frequently it is necessary to use organic solvents with the resultant difficulty and inconvenience of removing these solvents. Where the polymer can be applied from aqueous solution there is again a problem of drying, the removal of excess water requiring prolonged heating of the tablet.

Inorganic salt coatings have also been proposed in U.K. Pat. No. 1,031,831. The preferred coating material is sodium silicate solution. Again, an aqueous solution is applied to the tablet and this of course requires a drying step to remove the water before the coating is formed. Apart from the added complexity of a drying step, there is the further disadvantage that migration of excess water into the tablet may adversely affect the properties, especially solubility and storage stability, of the tablet.

It has also been proposed, for example in the co-pending U.S. Pat. application Ser. No. 910,915, Pracht and Gromer, filed May 30, 1978 (P&G Case CM-40), to employ molten organic materials for coating detergent tablets. Materials such as fatty alcohols, fatty acids and polyethylene glycols are said to be useful. While such materials do form good coatings and avoid many of the disadvantages mentioned above, they in turn have the disadvantage of influencing the performance of compositions or of dissolving too slowly. In particular, when we are concerned with tablet for use in automatic dishwashing machines, it is important that the compositions have little or no foaming ability. Materials such as polyethylene glycol have sufficient surface activity to produce excess foaming in such compositions, while a material like a fatty acid can adversely affect detergency performance or can even deposit on the articles being washed.

It is an object of the present invention to provide a detergent tablet with a coating which is easily applied and which does not suffer from the problems discussed above.

This and other objects are achieved by the use of certain hydrated salts as coating material for the tablets, the salts being applied in the form of a melt. Molten hydrated salts have been proposed for coating bleach particles (see U.K. Pat. No. 1,191,356 and U.S. Pat. No. 4,048,351), but it has not heretofore been recognised that detergent tablets could be coated in this manner with such surprisingly advantageous results.

According to the present invention, there is provided a detergent tablet having a core comprising an alkaline builder salt and provided with a coating of a hydrated salt having a melting point in the range of from 30° C. to 95° C., said coating having been applied to the tablet in the form of a melt.

In the context of the present invention, the term "detergent" does not necessarily imply the presence of a surfactant material. Tablets which exert their cleaning power solely by the presence of inorganic salts (such as phosphate and silicate) are encompassed within the present invention. The term "melt" will be defined hereinafter.

The present invention also provides a process for coating a detergent tablet comprising applying to the tablet a hydrated salt in the form of a melt, said hydrated salt having a melting point in the range from 30° C. to 95° C.

The Detergent Tablet

The detergent tablet which is to be provided with a coating according to the present invention can be of any type and can, for example, be adapted for laundry washing, dishwashing or any other type of cleaning operation which involves dissolution of the tablet in an aqueous medium.

In the body of the tablet is included an alkaline salt, preferably a water-soluble builder salt which normally provides a substantial part of the cleaning power of the tablet. The term "builder salt" is intended to mean all materials which tend to remove calcium ion from solution, either by ion exchange, complexation, sequestration or precipitation.

Preferred above all other salts for the purpose of providing alkalinity are water-soluble silicate salts.

Examples of suitable silicates are those having the general formula $nSiO_2.M_2O$ where n is from 0.5 to 4.0 and M is a cation imparting water-solubility to the salt, preferably an alkali metal such as sodium or potassium. Such silicates can contain up to 50% by weight of water in the form of water of hydration. Preferred materials are sodium metasilicate and sodium sesquisilicate. Sodium orthosilicate may be used where very high alkalinity is desired. Sodium metasilicate is very highly preferred. In preferred compositions intended for use in automatic dishwashing machines, the silicate salt (inclusive of any water of hydration) makes up more than 50% of the tablet, preferably from 60% to 80%. In compositions designed for laundry use, there is usually much less silicate, for example 5% to 15%.

Another preferred builder salt, usually employed in combination with the silicate salt (although possibly employed as the sole builder salt), is a water-soluble phosphate. Any water-soluble phosphate salt can be employed in the present invention, for example, sodium orthophosphate, pyrophosphate, tripolyphosphate or more condensed phosphates such as hexametaphosphate. Condensed phosphates are preferred, especially sodium tripolyphosphate. The phosphate salt can be in at least partially hydrated form, particular examples being pentasodium tripolyphosphate hexahydrate and tetrasodium pyrophosphate decahydrate.

In preferred compositions, especially for dishwashing products, the phosphate salt (inclusive of any hydrated water) makes up from 10% to 40%, preferably from 20% to 30% of the tablet.

Other useful inorganic alkaline builder salts, which can be employed alone, or preferably in admixture with the silicate and phosphate salts include water-soluble carbonates, bicarbonates and borates.

Water-soluble organic builder components may also be employed. Examples of suitable organic detergency builder salts are: (1) water-soluble amino polyacetates, e.g., sodium and potassium ethylene-diamine tetra-acetates, nitrilotriacetates, and N-(2-hydroxyethyl) nitrilodiacetates; (2) water-soluble salts of phytic acid, e.g., sodium and potassium phytates; and (3) water-soluble polyphosphonates, including alkali metal salts of ethane-1-hydroxy-1,1-diphosphonic acid; methylenediphosphonic acid, ethylene diamine tetramethylene phosphonic acid, nitrilotrimethylene phosphonic acid and the like.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable herein.

A further class of builder salts useful herein is the water-insoluble silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer of from about 15 to about 264. Compositions incorporating builder salts of this type form the subject of British Pat. No. 1,429,143 published Mar. 24, 1976, German Offenlegungsschrift No. 2,433,485 published Feb. 6, 1975 and Offenlegungsschrift No. 2,525,778 published Jan. 2, 1976, the disclosures of which are incorporated herein by reference.

Detergent tablets for use in the present invention can contain a water-soluble surfactant selected from anionic, nonionic, zwitterionic, amphoteric and cationic surfactants. Surfactants of these types are described in U.S. Pat. No. 3,929,678, the disclosure of which is incorporated herein by reference.

Laundry detergent tablets normally contain up to 15% of an anionic surfactant such as $C_8$–$C_{18}$ alkyl benzene sulphonates, $C_8$–$C_{18}$ alcohol sulphates, $C_8$–$C_{18}$ alcohol ethoxylate sulphates and fatty acid soaps. Tablets designed for use in automatic dishwashing machines can contain no surfactant, but frequently contain up to 10% of a nonionic surfactant.

Nonionic surfactants which are advantageously employed in the composition of this invention include, but are not limited to, the following polyoxyalkylene nonionic detergents: $C_8$–$C_{22}$ normal fatty alcohol-ethylene oxide condensates, i.e., condensation products of one mole of a fatty alcohol containing from 8 to 22 carbon atoms with from 2 to 20 moles of ethylene oxide, polyoxypropylene-polyoxyethylene condensates having the formula $HO(C_2H_4O)_x(C_3H_6O)_y(C_2H_4O)_{x1}H$ where y equals at least 15 and $(C_2H_4O)_{x+x1}$, equals 20–90% of the total weight of the compound; and alkyl polyoxypropylenepolyoxyethylene condensates having the formula $RO—(C_3H_6O)_x(C_2H_4O)_yH$ where R is a $C_1$–$C_{15}$ alkyl group and x and y each represent an integer of from 2 to 98.

Preferred nonionic surfactants for automatic dishwashing machine detergent tablets have very low sudsing ability. The afore-mentioned polyoxyethylene-polyoxypropylene surfactants are especially suitable in this respect. Specific surfactant materials which are preferred include Pluronic L-61, Lutensol LF-700 and the Plurafac series, especially Plurafac RA-40, RA-43 and RA-343.

Also useful in the present invention are the polyethylene glycols, for example those of molecular weight from 1,000 to 20,000, especially about 10,000. While these materials are not normally considered as surfactant materials, they do assist in improving the wetting ability of the compositions and they are also useful as processing aids in the tablet manufacture.

Detergent tablets of the present invention also preferably include a bleach component, preferably a chlorine bleach when a dishwashing composition is desired and an oxygen bleach when a laundry tablet is intended. Any of many known chlorine bleaches can be used in the present tablet. Examples of such bleach compounds are: chlorinated trisodium phosphate, dichloroisocyanuric acid, salts or chlorine substituted isocyanuric acid, 1,3-dichloro-5,5-dimethylhydantoin, N,N'-dichlorobenzoylene urea, paratoluene sulphodichloroamide, trichloromelamine, N-chloroammeline, N-chlorosuccinimide, N,N'-dichloroazodicarbonamide, N-chloroacetyl urea, N,N'-dichlorobiuret, chlorinated dicyandiamide, sodium hypochlorite, calcium hypochlorite, and lithium hypochlorite. The preferred bleach is an alkali-metal salt of dichloroisocyanuric acid, e.g., potassium or sodium dichloroisocyanurate especially sodium dichloroisocyanurate dihydrate.

Useful oxygen bleaches include sodium perborate, sodium percarbonate and sodium persulphate.

Neutral fillers such as sodium sulphate and sodium chloride can be present and various other components can be included for various purposes. Examples of such additional components are enzymes, especially proteases and amylases, (which are useful in the absence of chlorine bleach), suds-suppressing agents, tarnish inhibitors such as benzotriazole, bactericidal agents, soil-suspending agents, dyes, brighteners and perfumes.

Tablets to be coated in the present invention can be prepared simply by mixing the solid ingredients together and compressing the mixture in a conventional tablet press as used, for example, in the pharmaceutical industry. Any liquid ingredients, for example the surfactant or suds suppressor, can be incorporated in a conventional manner into the solid particulate ingredients. Preferably the principal ingredients, silicate and phosphate, are used in granular form.

Alternatively, especially for laundry tablets, the ingredients such as builder salt and surfactant can be spray-dried in a conventional manner and then compacted at a suitable pressure.

A suitable process for manufacturing detergent tablets is described in U.S. Pat. No. 3,081,267, the disclosure of which is incorporated herein by reference.

The present invention is particularly applicable to the automatic dishwashing machine tablets described in the abovementioned pending U.S. application Ser. No. 910,915, filed May 30, 1978. These tablets are highly alkaline and have a high density of at least 1.4 g/cc and preferably about 1.5 g/cc, for example 1.6–1.7.

The detergent tablets can be made in any size or shape and can, if desired, be surface treated before coating according to the present invention. For example, it may be desired to water-spray the surface as described in U.S. Pat. No. 3,081,267 to provide added surface integrity during subsequent handling steps.

The Coating

However the detergent tablets are prepared and in whatever form they are, they are then coated according to the present with a hydrated salt having a melting point of from 30° C. to 95° C.

It is an essential part of the present invention that the coating is applied in a state wherein it essentially solidifies on the tablet rather than dries on to it. It is therefore essential that the salt be applied at a temperature in excess of its melting point. Clearly salts having a melting point below 30° C. are not sufficiently solid at ambient temperatures and it has been found that salts having a melting point above about 95° C. lose their water of hydration so quickly after melting that it is not practicable to use these materials. Preferably, the salts melt in the range from 35° C. to 75° C., more preferably from 45° C. to 70° C.

By "melting point" is meant the temperature at which the salt when heated slowly in, for example, a capillary tube becomes a clear liquid. It will be understood that this is the point at which the salt dissolves in its own water of crystallisation. Solidification of this salt does not involve any loss of water, as the crystalline hydrate is again formed.

Any salt having a melting point in the required range and forming a hydrated species can be employed. This includes both inorganic and organic salts.

Suitable materials include sodium acetate trihydrate, sodium metaborate tetrahydrate, or octahydrate, sodium orthophosphate dodecahydrate, sodium dihydrogen phosphate dihydrate, the di-, hepta- or dodecahydrate of disodium hydrogen phosphate, sodium potassium tartrate tetrahydrate, potassium aluminium sulphate dodecahydrate, calcium bromide hexahydrate and calcium nitrate tetrahydrate.

Highly preferred materials are sodium acetate trihydrate and sodium metaborate tetrahydrate. Mixtures of these two materials in proportions of metaborate:acetate by weight of from 3:1 to 1:3, preferably 2:1 to 1:2, are still more preferred.

When the above mentioned hydrated salts are heated to an appropriate temperature, they form a clear liquid phase and detergent tablets of the type described above are coated with the molten hydrated salt. The molten salt can be applied to the tablet in any convenient way, for example by spraying or dipping. Normally, when the molten salt is sprayed on to the tablets, it will solidify almost instantaneously to form a coherent coating. When tablets are dipped into the molten salt and then removed, the rapid cooling again causes almost instantaneous solidification of the coating material.

Certain of the hydrated salts form melts which tend to be too viscous for easy spraying. Also, the heating of the salt tends to drive off part of the water of hydration, thus also increasing viscosity and tending to cause premature crystallisation of the salt. This can be avoided by adding a small amount of water to the molten salt and, in the context of the present invention, the term "melt" is intended to mean both the true molten hydrated salt and the molten salt when diluted with water. However, it should be understood that the diluted molten salt will still behave as a molten phase, i.e. it will, on cooling, solidify without the need for substantial drying or removal of excess water. Normally, any water added to the melt should not exceed 30% by weight of the melt, preferably not more than 20%, for example from 5% to 15%. The presence of a slight excess of water can provide a further advantage in that migration of this water into the tablet results in an increase in tablet strength.

A coating of any desired thickness can be applied according to the present invention. For most purposes, the coating forms from 1% to 10%, preferably from 1.5% to 5%, of the tablet weight.

The tablet coatings of the present invention are very hard and yet still highly soluble, are more stable than many organic coatings and are neutral to tablet solubility, and performance. Apart from the afore-mentioned water, the coating melt can contain minor quantities of other ingredients, for example, dyestuffs, perfume, opacifier, suds suppressor, surfactant (especially nonionic surfactant), etc.

The following Examples illustrate the present invention.

EXAMPLE 1

Granular sodium metasilicate (34.0 g.), granular sodium tripolyphosphate (12.0 g.), sodium aluminate (0.08 g.) and sodium dichloroisocyanurate (1.1 g.) were blended together in a mixing vessel to form a homogeneous particulate mixture. About 23 g. of this mixture were introduced into a mould of triangular shape with equilateral triangle sides of 3.3 cm and were compressed in this mould under a pressure of about 470 Kg/sq. cm to give a tablet of about 1.9 cm thickness and a density of about 1.7 g/cc.

Sodium metaborate tetrahydrate (60 parts) and sodium acetate trihydrate (40 parts) were mixed in a stainless steel container and heated with gentle stirring until molten (a temperature of about 90° C.). The molten product was a clear liquid with a viscosity of about 15 cP. The melt was then sprayed on to the tablet prepared as above to give a final coated tablet weight of 24.2 g.

EXAMPLE 2

Following the procedure of Example 1, a tablet was prepared and the melt of sodium metaborate and sodium acetate was made. To this melt (100 parts) was added 5 parts of water and the diluted melt was sprayed as before to give a coating of 5% of the tablet weight.

The above procedure was repeated but using 10 parts of water to dilute the melt. This made it easier to spray the melt and avoided a tendency for blockage of the spray nozzle.

The coated tablets of Examples 1 and 2 are especially suitable for use in automatic dishwashing machines and have an excellent, strong, water-soluble coating.

EXAMPLE 3

Similar results are obtained when the procedures of Examples 1 and 2 are followed, but using as the melt material any one of the following: - sodium acetate trihydrate, sodium metaborate tetrahydrate, sodium orthophosphate dodecahydrate, sodium potassium tartrate and potassium aluminium sulphate.

EXAMPLE 4

A spray-dried granular detergent composition has the following composition:

| | Parts |
|---|---|
| sodium tripolyphosphate | 28 |
| sodium alkyl benzene sulfonate | 20 |
| sodium sulfate | 27 |
| sodium silicate having an $SiO_2$ to $Na_2O$ ratio of 2:1 | 14 |
| sodium carboxymethyl cellulose | 0.7 |
| optical brightener | 0.14 |
| a 1:1 mixture of Pluronic F68 and L64 (condensation products of ethylene oxide and the reaction product of propylene oxide and propylene glycol. They have molecular weights of about 8000 and 3000 respectively) | 2.8 |
| a mixture of hydrogenated fish oil fatty acids (a suds depressor described in British Patent 808,945) | 2.8 |
| moisture | 4 |

990 parts of this spray dried composition are uniformly mixed with 840 parts of anhydrous granular sodium tripolyphosphate and 2 parts by weight of perfume are sprayed on the mixture.

An aliquot of the mixture is charged into a tablet cavity and formed under a pressure of 5 kg/sq.cm into a tablet.

The tablet is then coated with a mixture of sodium metaborate and sodium acetate according to the procedures of Examples 1 or 2. The coated tablet is suitable for use as a laundry detergent tablet.

Substantially similar results are obtained when the materials indicated in Example 3 are used as coating agents.

EXAMPLE 5

The procedure of Example 1 is repeated except that the tablet was dipped into the melt of sodium tetraborate and sodium acetate and then removed. The melt solidified quickly at ambient temperatures and a coated tablet was obtained having a coating weight of about 5% of the total tablet weight.

What is claimed is:

1. A detergent table having a core comprising an alkaline builder salt and provided with a coating, which comprises from 1% to 10% by weight of the tablet, of a hydrated salt having a melting point in the range of from 30° C. to 95° C., selected from the group consisting of hydrates of sodium acetate, sodium orthophosphate, di-sodium hydrogen phosphate, sodium dihydrogen phosphate, sodium potassium tartrate, potassium aluminum sulphate, calcium bromide, calcium nitrate, and mixtures thereof, said coating having been applied to the tablet in the form of a melt.

2. The tablet of claim 1 wherein the melting point of the hydrated salt is from 35° C. to 75° C.

3. The tablet of claim 2 wherein the said melting point is from 45° C. to 70° C.

4. The tablet of claim 2 wherein said hydrated salt comprises sodium acetate trihydrate.

5. An automatic dishwasher detergent tablet according to claim 1 which contains, as its sole surfactant component, from 0 to 10% of a nonionic surfactant.

6. A detergent tablet having a core consisting essentially of a mixture of a water-soluble silicate salt and a water-soluble phosphate salt in a weight ratio of at least 1:1, the tablet core being provided with from 1% to 10% by weight of the tablet of a coating of a hydrated salt selected from the group consisting of hydrates of sodium acetate, sodium orthophosphate, disodium hydrogen phosphate, sodium dihydrogen phosphate, sodium potassium tartrate, potassium aluminum sulphate and calcium bromide, said coating having been applied to the tablet in the form of a melt.

7. A detergent tablet having a core comprising an alkaline builder salt and provided with a coating, which comprises from 1% to 10% by weight of the tablet, of a hydrated salt having a melting point in the range of from 30° C. to 95° C., said hydrated salt being a mixture of sodium acetate trihydrate and sodium metaborate tetrahydrate in a proportion by weight of from 3:1 to 1:3, said coating having been applied to the tablet in the form of a melt.

8. A process for coating a detergent tablet comprising applying to the tablet an amount of from 1% to 10% by weight of the finished tablet of a hydrated salt in the form of a melt, said hydrated salt having a melting point in the range of from 30° C. to 95° C. and being selected from the group consisting of hydrates of sodium acetate, sodium ortho-phosphate, di-sodium hydrogen phosphate, sodium di-hydrogen phosphate, sodium potassium tartrate, potassium aluminum sulphate, calcium bromide, calcium nitrate, and mixtures thereof.

9. The process of claim 8 wherein the said melting point is from 35° C. to 75° C.

10. The process of claim 9 wherein the melt comprises the hydrated salt in a molten state and up to 20% by weight of the melt of water.

11. The process of claim 10 wherein the melt is applied to the tablet by spraying.

* * * * *